US006516572B1

(12) United States Patent
Nowacek et al.

(10) Patent No.: US 6,516,572 B1
(45) **Date of Patent: *Feb. 11, 2003**

(54) SLATE AND INTERLAYMENT ROOF AND A METHOD OF PREPARING THE SAME

(76) Inventors: David C. Nowacek, 1100 NE. Loop 410, Suite 617, San Antonio, TX (US) 78209; James J. Nowacek, 1100 NE. Loop 410, Suite 617, San Antonio, TX (US) 78209

( * ) Notice: Subject to any disclaimer, the term of this patent is extended or adjusted under 35 U.S.C. 154(b) by 0 days.

This patent is subject to a terminal disclaimer.

(21) Appl. No.: 09/659,231

(22) Filed: Sep. 11, 2000

(51) Int. Cl.[7] ..... E04B 7/02

(52) U.S. Cl. ..... 52/90.1; 52/105; 52/551; 52/518; 428/150

(58) Field of Search ..... 52/518, 748.1

(56) References Cited

U.S. PATENT DOCUMENTS

| | | | | | |
|---|---|---|---|---|---|
| 3,803,792 | A | | 4/1974 | Fulton | 52/533 |
| 3,885,075 | A | * | 5/1975 | Ferrante | 428/150 |
| 4,694,716 | A | | 9/1987 | Sakamoto | 83/112 |
| 5,086,552 | A | | 2/1992 | Moore | 29/403 |
| 5,258,222 | A | | 11/1993 | Crivelli | 428/323 |
| 5,527,409 | A | | 6/1996 | Lanphier | 156/71 |
| 5,570,553 | A | * | 11/1996 | Balkins | 52/518 |
| 5,791,112 | A | * | 8/1998 | Plum | 52/551 |
| 6,148,578 | A | * | 11/2000 | Norwacek et al. | 52/518 |
| 6,237,288 | B1 | * | 5/2001 | Jenkins et al. | 52/105 |

OTHER PUBLICATIONS

The NRCA Roofing and Waterproofing Manual–Fourth Ed.; p. 1196.*

Pawley *Building for Tomorrow; Putting Waste to Work* (a Sierra Club Book); pp. 131–135.

The NRCA Roofing and Waterproofing Manual—Fourth Ed.; p. 1196.

* cited by examiner

*Primary Examiner*—Carl D. Friedman
*Assistant Examiner*—Steve Varner
(74) *Attorney, Agent, or Firm*—Jackson Walker LLP

(57) ABSTRACT

An improved roof and method wherein each course of slate is underlaid with an interlayment material layer such that the interlayment material acts as a base to the through joints, resulting in a reduction in the amount of slate used by approximately 40% to 50%. The slate meets side to side (the through joint), the underlaying interlayment material providing sufficient waterproofing to protect the roof as well as being of lighter weight and a more economical slate roof than the slate which it replaces.

8 Claims, 5 Drawing Sheets

SLATE AND INTERLAYMENT ROOF AND A METHOD OF PREPARING THE SAME

FIELD OF THE INVENTION

Roofs, more particularly slate roofs, with an interlayment layer between courses of slate and a method of making slate roofs.

BACKGROUND OF THE INVENTION

Slate roofs are appreciated for their aesthetic and durable qualities. However, they are expensive and the weight of the slate is quite high compared to composition shingles; and, as a result, they are typically two to four times more expensive as composition asphalt roofing. Thus, utility lies in any application of slate on a roof which will reduce the amount of slate needed to effectively cover a roof. Applicants' method and slate roof herein provide for such utility.

A good background for slate roofing and the method for installing the same may be found in the NRCA Roofing and Waterproofing Manual—4th Edition, pp. 1179–1227, that document being incorporated herein by reference. Typical slate roofs are constructed in the manner set forth in FIG. 1, labeled "prior art". With reference to FIG. 1, it is seen that a wood roof is first covered with an underlayment layer, typically asphalt felt paper, to which overlapping slate courses are applied with slate covering the roof in two plies except where there is overlap, in which case there are three plies of slate. Through joints should not occur from the slate roof surface to the felt.

Applicant, however, has removed a slate layer and replaced it with heavy-duty, weatherproof interlayment material layer, typically plastic 20 to 60 mil in thickness.

SUMMARY OF THE INVENTION

In Applicants' improved roof and method illustrated in FIGS. 2 to 6 attached hereto, each course of slate is underlaid with an interlayment material layer such that the interlayment material acts as a base to the through joints. This reduces the amount of slate used by approximately 40% to 50%. Moreover, where Applicants' slate meets side to side (the through joint), the underlaying interlayment material provides sufficient waterproofing to protect the roof. The interlayment material is also less expensive and lighter weight than the slate it replaces.

Applicants' present invention improves upon all prior art slate roofs by providing for a markedly improved weather barrier, lighter weight, and more economical slate roof.

DETAILED DESCRIPTION OF THE PREFERRED EMBODIMENT

Figure 1:
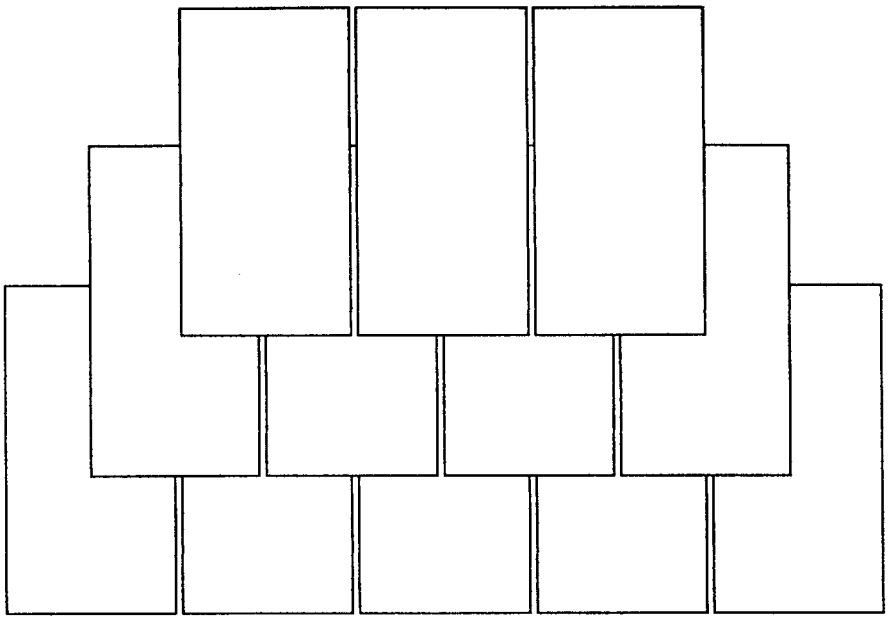
Fig. 1 (PRIOR ART)
FIG. 1 illustrates a prior art slate roof with two plies of slate over the underlayment material (three plies on overlap)
Figure 2:
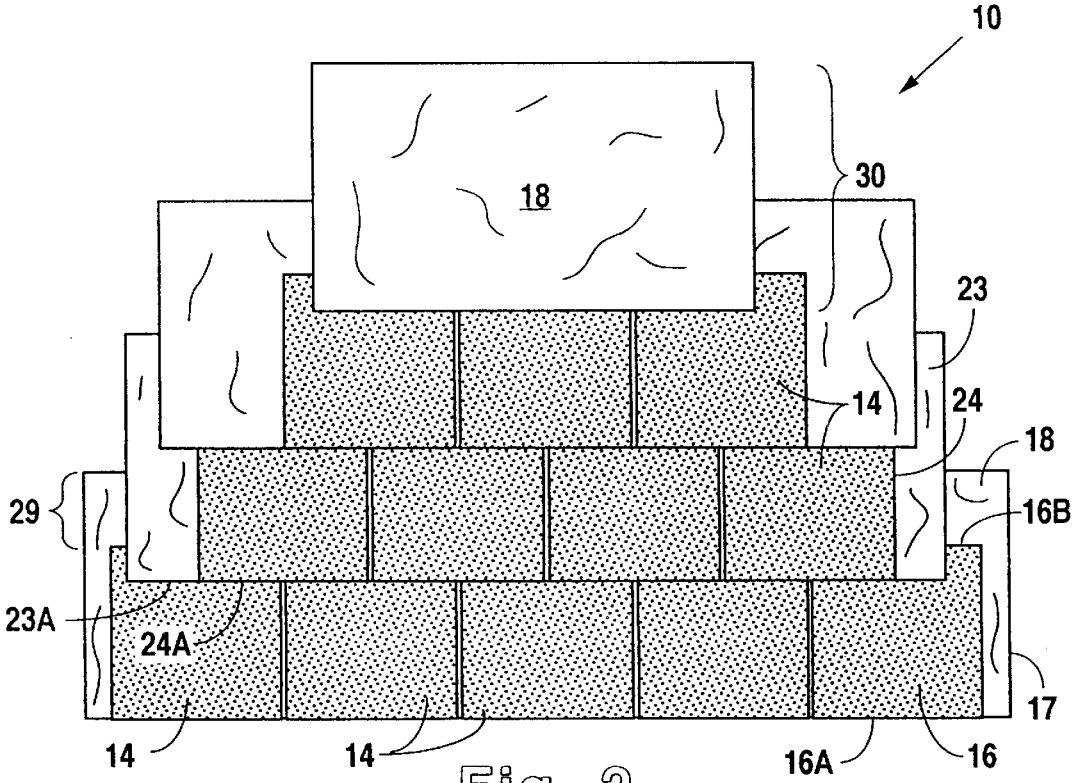
FIG. 2 illustrates Applicants' improved roof with an interlayment material between the slate courses and between the slate courses and between the slate courses and the underlayment material.
Figure 3:
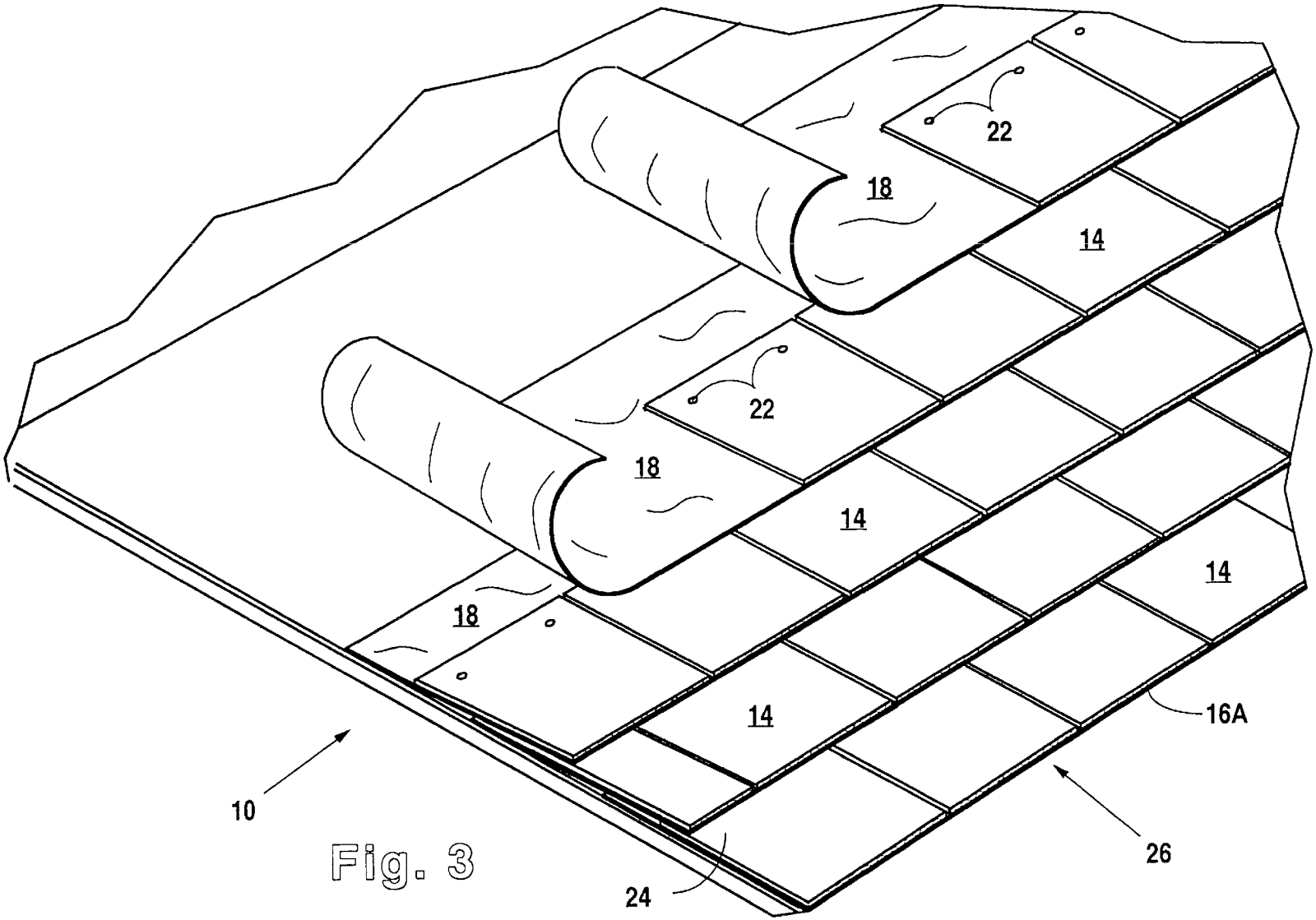
FIG. 3 is a perspective view of Applicants' slate roof featuring interlayment material between slate courses.
Figure 4:
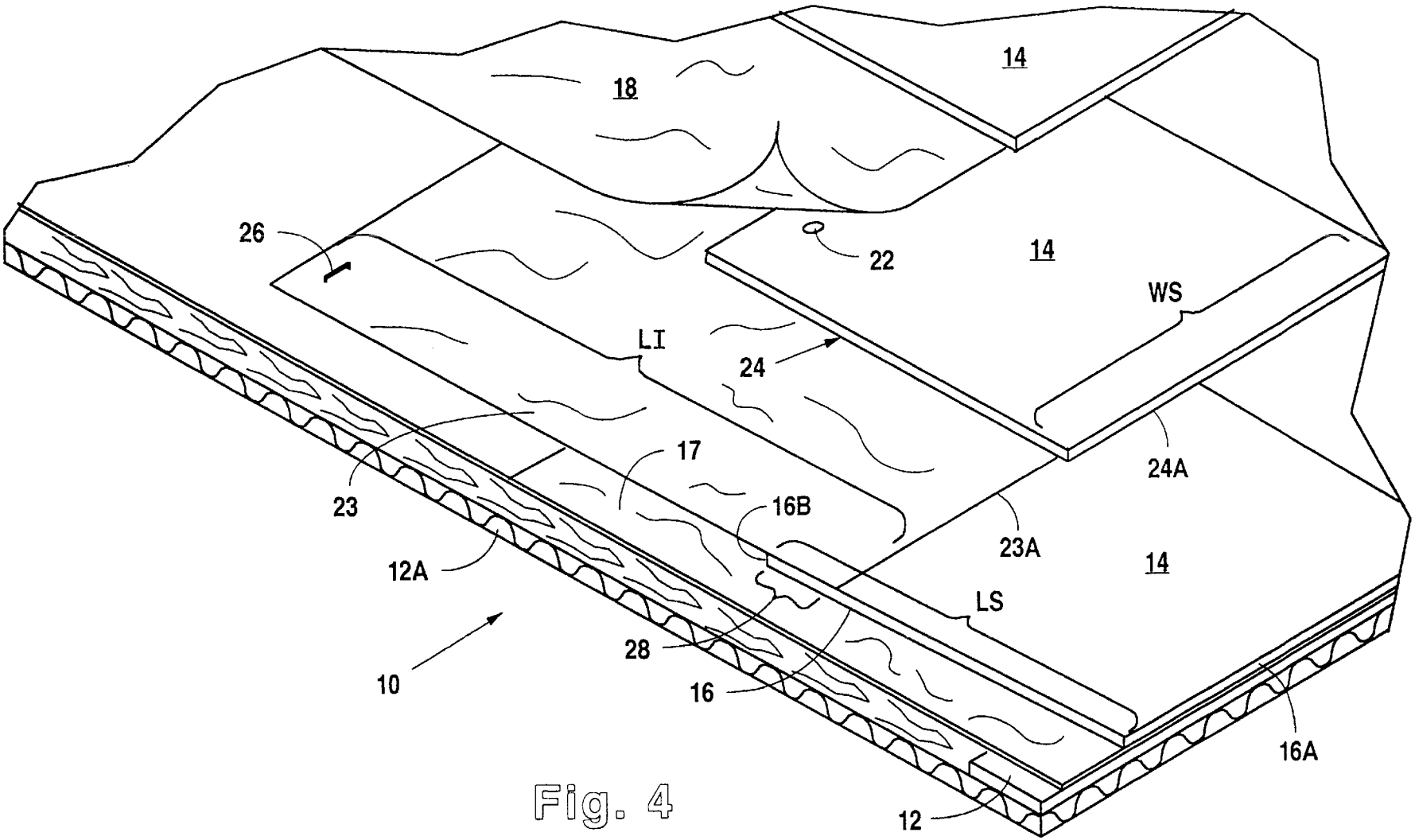
FIG. 4 is a perspective cross-sectional view of Applicants' slate roof illustrating the use of an interlayment material layer between slate courses.

Applicants' method utilizes some of the same steps of the prior art in preparing a unique slate/interlayment roof (10). With reference to FIGS. 1–4, it is seen that a starter strip of wood (12), about the thickness of a slate tile (14), is typically used for the first course (16). Underlaying the first course (16) at the leading edge thereof (16A) is a sheet of interlayment material (18), typically 12" to 18" long (LI) and about 30 mil. The first course of slate (16) is laid on top of the starter strip (12) and fastened to the roof base deck (12*a*) over a first course (17) interlayment material (18) with nails (22) driven through the slate and interlayment material as well as through the felt underlayment.

The next step is to apply the second course (23) of interlayment material (18) by overlapping approximately 2" to 3" over the top of the trailing edge (16B) of the first course of slate (16). The interlayment material (18) is then fastened to the roof through the use of staples (26) or the like. The next step is the fastening of the second course of slate (24) to the roof in a manner known in the trade by driving nails (22) therethrough. The individual slate tiles (14) of this second course (24) are placed with their leading edges (24A) flush or slightly overlapping (⅛" to ¼") with the leading edge (23A) of the second course (23) of interlayment material and abutted one against the other. Additional courses of interlayment material and shingles are applied in this manner with alternating layers of the interlayment layer and shingles.

The resulting cross section is a roof with a single thickness of slate tiles except on the overlap portion (28), where there is a dual thickness of slate tiles (14). However, at all points the slate is underlaid by an interlayment material (18).

The characteristics of the interlayment material are that it should be of sufficient thickness and durability such that it will not break down when exposed to weathering. A UV resistant interlayment material is advisable. For example, a thermoplastic elastomer or high-density polyethylene, such as those used in geomembrane barriers, is appropriate. Further, single-ply rubber roofing membrane may be used as an appropriate interlayment material. The following may also be used: thermoplastic olefin, high-density polyethylene, thermoplastic elastomers, ethylenepropylene-diene, monomer, polypropylene, and styreneethylene-butadiene-styrene or any other suitable material.

Typical widths (30) of the interlayment material are such that it will extend at least 2" to 3" beyond the trailing edge of the overlaying slate in overlap (29). It may come in 25' to 100' rolls and is cut to whatever length is needed. If it is necessary to use more than one piece of interlayment material per course, a side-to-side overlap of about 6" is recommended.

On prior art roofs, the length of the slate tiles is the exposure ×2 plus about 3". For example, typical prior art slate tiles are 9"×18", which gives an effective exposure of about 7.5". Applicants' slate tiles, however, can achieve the same 7.5" exposure with a 9" piece of slate. the width of Applicants' slate tiles may be the same as the prior art (typically 6" to 12") or any other appropriate width.

Figure 5A:
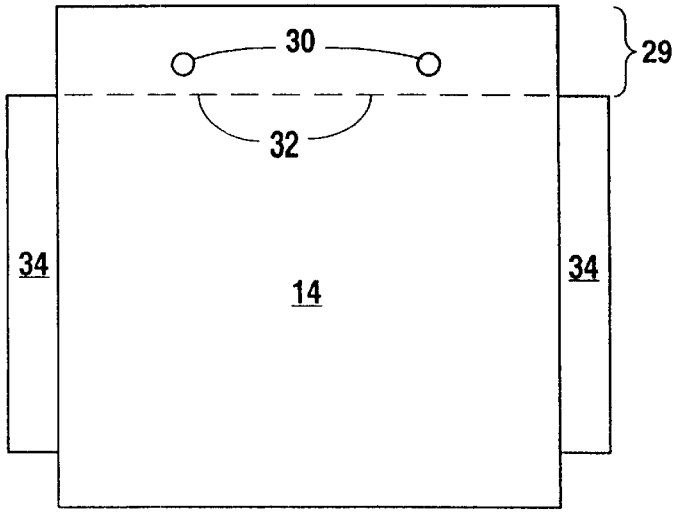
FIGS. 5*a*–5*c* are elevational views of additional features of Applicants' slate roof.
Figure 5B:
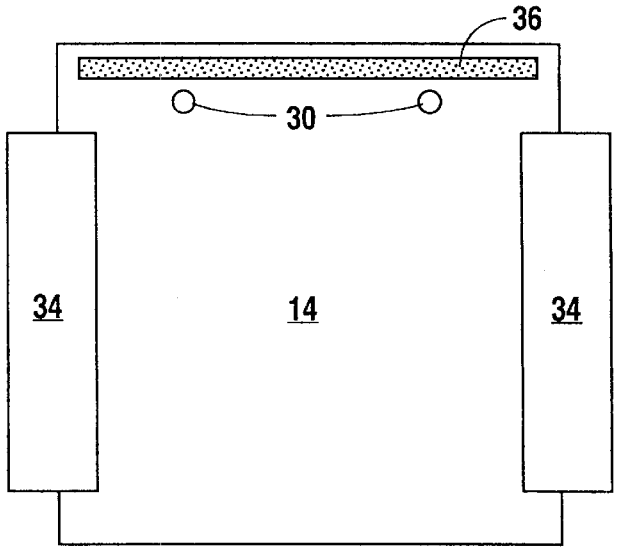
Figure 5C:
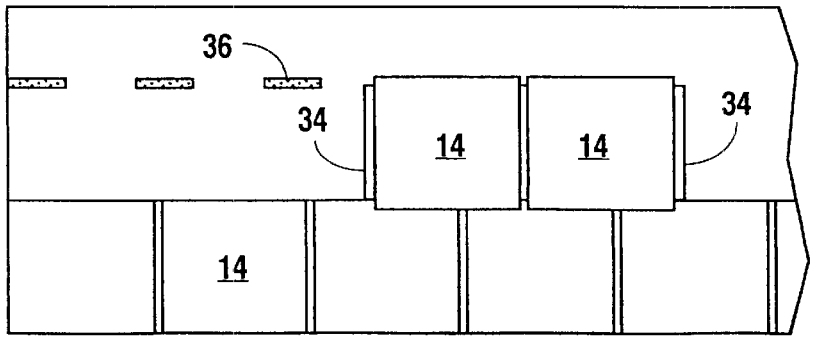

FIGS. 5*a*–5*c* illustrate additional features of Applicants' present invention. FIG. 5*a* illustrates a slate tile with pre-drilled holes (30) with and marked or scored (32) for alignment and positioning of interlayment overlap (29).

FIG. 5*a* also shows slate side members or wings (34) attached to the underside of the slate tile for additional through joint weather protection, typically being made of rubber, plastic, or asphalt/fiberglass material.

FIG. 5*b* illustrates a double-sided adhesive tape strip (36) attached to the underside of a slate tile adjacent the trailing edge thereof to hold the tile temporarily in place while it is being nailed to the roof.

FIG. 5*c* illustrates the use of adhesive strips (36) on the interlayment material to assist in holding the slate in place during installation.

Figure 6:
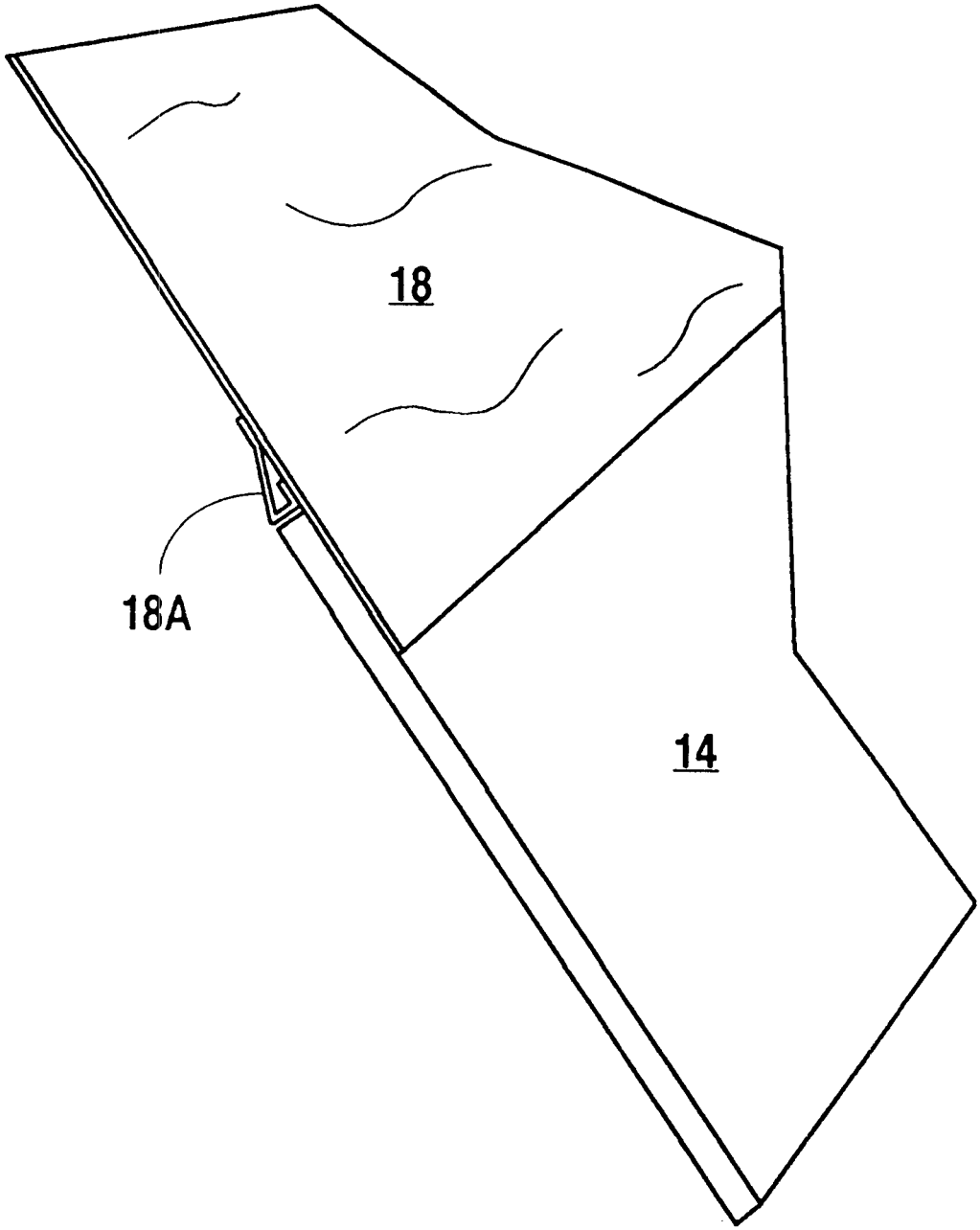
FIG. 6 is a perspective view of yet an additional feature of Applicants' slate roof.

FIG. 6 illustrates a modification of the interlayment material featuring a flap member (18A) attached to the underside thereof to act as a water trap for protection against wind-driven rain.

This flap (18A) at the lower course boundary of the interlayment material should abut the top edge of the underlying slate course to provide a water trap should any water be driven up underneath the shingle.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A pitched roof having a deck, the deck substantially covered by a multiplicity of slate courses, each of the multiplicity of slate courses being comprised of a multiplicity individual slate members, each of the individual slate members having a substantially similar, generally rectangular shape including a lower edge and an upper edge and two side edges, each of the slate courses including multiplicity of slate members with their lower edges and upper edges aligned and their side edges aligned adjacent to other slate members of the slate course, at least some the slate courses of said pitched roof comprising:

a first interlayment member, the first interlayment member having an upper edge and a lower edge, the first interlayment member for underlaying all of each slate member of the slate course, with the leading edge of the first interlayment member coincide with the leading of the slate course; and, a second interlayment member, the second interlayment member having an upper edge and a lower edge, the second interlayment member for overlaying part of each slate member of the slate course with the leading edge of the second interlayment member closer to the aligned upper edges of the individual slates members of the slate course then to the aligned lower edges and with the upper edge of the second interlayment member extending beyond the upper edge of the first interlayment member so as to partially overlap the first interlayment member.

2. The pitched roof of claim 1 wherein the first interlayment member and the second interlayment member are similarity dimensioned.

3. The pitched roof of claim 1 wherein the first interlayment member and the second interlayment member are comprised of UV resistant plastic.

4. The pitched roof of claim 3 wherein the first interlayment member and the second interlayment member are comprised of a modified asphalt material.

5. A method for installing the slate course as set forth in claim 1 to the roof, the method including the steps of:

fastening an underlayment material to the deck;

applying the first interlayment member onto the underlayment material;

applying a first course of slate members, the lower edge of the slate members adjacent the lower of the first interlayment member, the upper edge of the first course of the slate members below the upper edge of the first interlayment material;

applying the second interlayment member by overlapping the upper edge of the first course of the slate members and partially overlapping the first interlayment member, but applying the second interlayment material so the leading edge overlaps and extends below the trailing edge of the first interlayment member; and, applying a second course of slate members with the lower edge of the members of the second course coincident with the lower edge of the second interlayment material; and applying subsequent interlayment and slate courses.

6. The method of claim 5 wherein at least some of the individual slate members include adhesive means on a surface thereof to help hold the tiles of the tile course in place during construction of the roof.

7. The method of claim 5 wherein at least some of the multiplicity of individual slate members have holes predrilled therein.

8. The method of claim 5 wherein at least some of the individual slate members have indicia on the surface thereof to assist and alignment during installation of the roof; and further including the step of utilizing the inidicia on the surface of the slate members to align the slate members of the second and subsequent courses.

* * * * *